United States Patent [19]

Starke et al.

[11] 4,432,772

[45] Feb. 21, 1984

[54] SLAG BREAKER OF PRESSURE-TYPE COAL GASIFIER

[75] Inventors: Joachim Starke; Adolf Jakubik; Erich Girodi, all of Hoyerswerda; Manfred Strüdinger; Reinhard Exner, both of Cottbus, all of German Democratic Rep.

[73] Assignee: Veb Gaskombinat Schwarze Pumpe, Schwarze Pumpe, German Democratic Rep.

[21] Appl. No.: 371,183

[22] Filed: Apr. 23, 1982

[30] Foreign Application Priority Data

| | | | |
|---|---|---|---|
| Apr. 11, 1981 | [AT] | Austria | 4730/81 |
| May 22, 1981 | [DD] | German Democratic Rep. | 230178 |
| Nov. 26, 1981 | [JP] | Japan | 56-188498 |

[51] Int. Cl.[3] ..... C10J 3/72

[52] U.S. Cl. ..... 48/66; 48/68; 48/77; 48/87; 110/165 R; 126/182; 241/186 R; 241/189 R; 241/277

[58] Field of Search ..... 48/87, 76, 77, 66, 68; 126/182; 110/165 R; 241/186 R, 189 R, 277

[56] References Cited

U.S. PATENT DOCUMENTS

| | | | |
|---|---|---|---|
| 1,888,661 | 11/1932 | Fleming | 126/182 X |
| 2,017,340 | 10/1935 | Corbett | 126/182 X |
| 4,137,051 | 1/1979 | Godwin | 48/87 X |

*Primary Examiner*—Arthur D. Kellogg
*Attorney, Agent, or Firm*—Michael J. Striker

[57] ABSTRACT

A slag breaker of a pressure-type coal gasifier having a rotary grate with a plurality of grate segments, a generator bottom and an ash separator, has an inclined breaking plate arranged to be located immediately below the grate segment and prior to the ash separator and provided with a plurality of breaking projections, and a wear sheet arranged to be located on the generator bottom and provided with a plurality of breaking webs.

13 Claims, 3 Drawing Figures

SLAG BREAKER OF PRESSURE-TYPE COAL GASIFIER

BACKGROUND OF THE INVENTION

The present invention relates to the field of thermal treatment of coal particularly in solid bed pressure-type gas generators for producing sewer or synthetic gases, wherein slag forming materials are subjected to gasification.

More particularly, the present invention relates to a slag breaker for a pressure-type coal gasifier.

During pressure-type coal gasification with reduced ratio of vapor-oxygen, an increased slag component in ash takes place because of the high temperature in the reactor, which can lead to disturbances in the ask discharge system. There are many proposals to reduce the slag content in the ash discharge system. In accordance with the patent of the German Democratic Republic No. 15,042 a slag breaking device is provided between a rotary grate and a cooling water jacket of a generator in a pressure-type gasifier. The rotary grate is equipped at its periphery with breaking teeth and formed as a coffeemill-like breaking mechanism together with a breaking ring which is stationarily mounted opposite to the cooling water jacket and also provided with breaking teeth. This construction possesses the disadvantage in the fact that the discharge opening between the rotary grate and the generator cooling water jacket is narrowed, which prevents a uniform lowering of the coal filling in the reactor and results in a so-called wall formation, or in other words depositing and clogging of ash over the outer breaking rim to the height of the generator roof. When the breaking is performed in accordance with this approach, the starting moment is very high so that drive damages must be taken into consideration.

The patent of the German Democratic Republic No. C10J/227156 discloses a slag comminuter in which a stationary central column is arranged centrally below the rotary grate in a milling shaft and provided with breaking arms, and the opposite inner wall of the hollow shaft is provided with a cam. This breaking device is very expensive inasmuch as mounting of the central column is problematic.

A Czechoslavakian publication discloses a rotary grate formed as a slag breaker and shaped as a rounder unilateral triangle. Big slag pieces in this construction get in the wide gap between the rotary grate and the water jacket and then displace, because of the grate rotation, to the gap of smaller width and broken therein. Practical experiments have shown that in this solution displacement of the ash discharge takes place.

U.S. Pat. No. 4,073,629 discloses a breaking device which includes a two-roller breaker located under the rotary grate. This construction is provided with a separate drive which is disadvantageous and requires special and repair-expensive sealing.

Generally speaking it is possible to arrange all known breakers below the rotary grate or the closing system in the ash discharge. The disadvantage of this arrangement of the breakers arranged in the ash discharge corresponds to the disadvantages of the above-mentioned two-roller breaker according to U.S. Pat. No. 4,073,629 and thereby such a construction is unacceptable.

SUMMARY OF THE INVENTION

Accordingly, it is an object of the present invention to provide a slag breaker of a pressure-type coal gasifier, which avoids the disadvantages of the prior art.

More particularly, it is an object of the present invention to provide a slag breaker for a pressure-type coal gasifier, which provides for breaking of slag and guarantees a failure-free operation of the pressure-type gas generator.

In keeping with these objects and others which will become apparent hereinafter, one feature of the present invention resides, briefly stated, in a slag breaker which has an inclined breaking plate arranged to be located immediately below grate segments of a rotary grate and prior to an ash separator and provided with a plurality of breaking projections, and a wear sheet arranged to be located on a generator bottom and provided with a plurality of breaking webs.

When the slag breaker is designed in accordance with the present invention, it avoids the disadvantages of the prior art.

In accordance with another feature of the present invention, the breaking plate is inclined relative to the direction of rotation of the rotary grate by a falling angle of substantially between 10 and 15°, preferably 12°. The breaking plate is also inclined in a radial direction toward the ash separator by a falling angle of substantially between 5 and 10°, preferably 6°. The breaking projections are provided on the thus-inclined breaking plate.

For covering the ash window, or the opening for passage of ash through the hollow shaft for adjustment of the desired output grain size of the slag, a ring subdivided in mounting condition is arranged to close the ash window from above. A ring may be mounted detachably or fixedly on the hollow shaft.

Breaking of the slag pieces is carried out in such a manner that during rotation of the rotary grate the slag pieces displace into several wedge-shaped breaking gaps which are formed by the breaking plates mounted at the lower side of the rotary grate segments, on the other one, and by the breaking webs on the wear sheet of the generator bottom. During the operation of the generator, the discharged ash and slag is transported by the known ash separator which is mounted on the rotary grate and rotates horizontally by the latter, into the closed space below the rotary grate. Ash and small grain slag fall through the hollow shaft into the ash lock. The greater slag pieces are retained because of the upper limit of the ash window of the hollow shaft and broken by the breaking plate inclined by the angle of 10–15° and rotatable about the central axis during the rotation of the rotary grate. This breakage is performed until they pass through the ash window. The number of the breaking plates can be varied in dependence upon the driven force and bearing force between 1 and 24.

In accordance with still another feature of the present invention, the breaking plates can be provided with opposite inclinations in the direction of rotation, so that the breaking gaps are available in both directions. This allows breakage of slag during left and right running of the rotary grate.

The slag breaker in accordance with the present invention guarantees comminution of the slag pieces prior to passage of the narrow lock and the transport means, so that disturbances and excessively high wear of these machine parts can be eliminated and a separate breaking drive which usually requires damage-sensitive sealing can be dispensed with. The arrangement can be manufactured with low cost.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
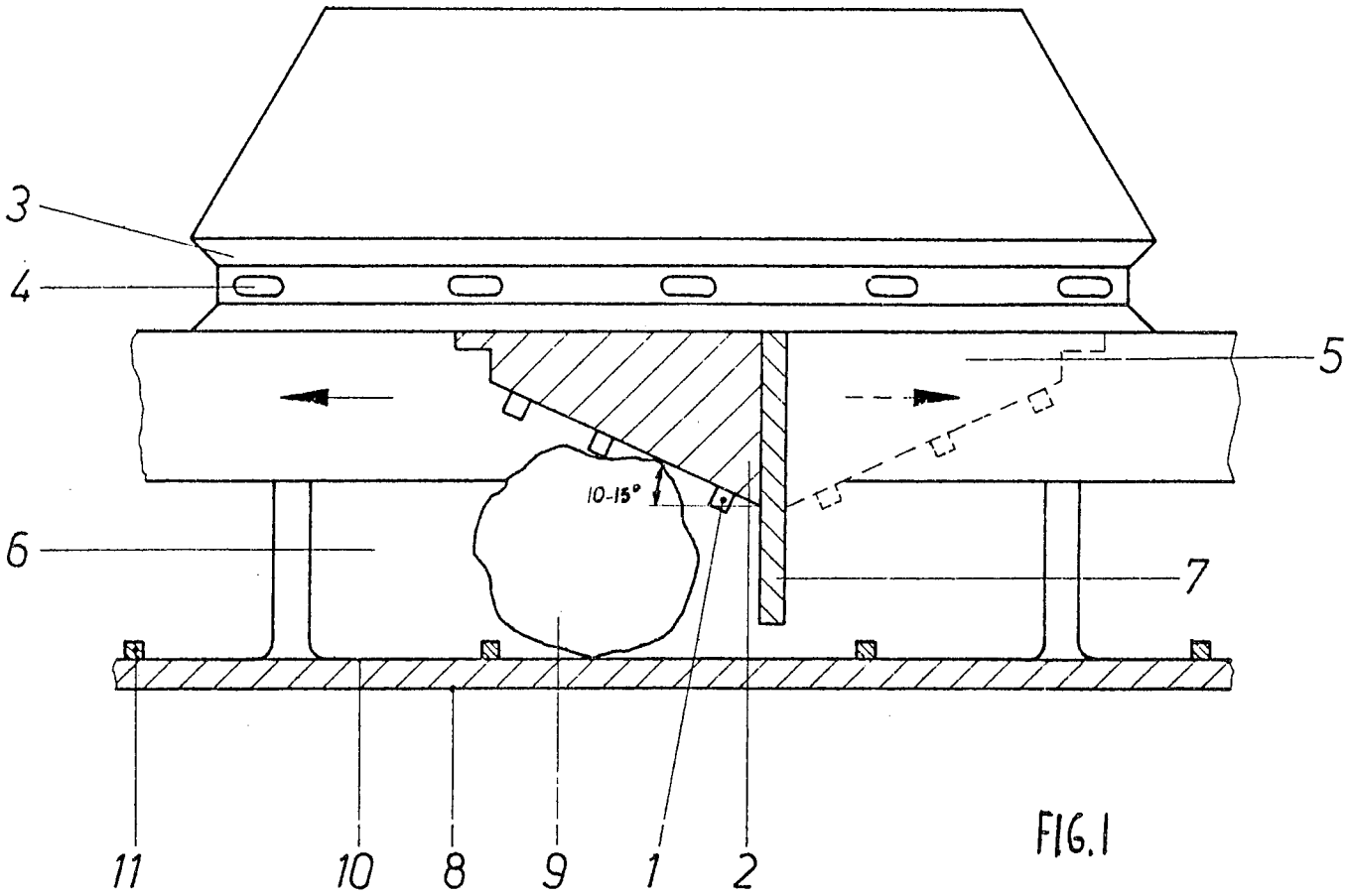
FIG. 1 of the drawing is a view showing a slag breaker in accordance with the present invention.
Figure 2:
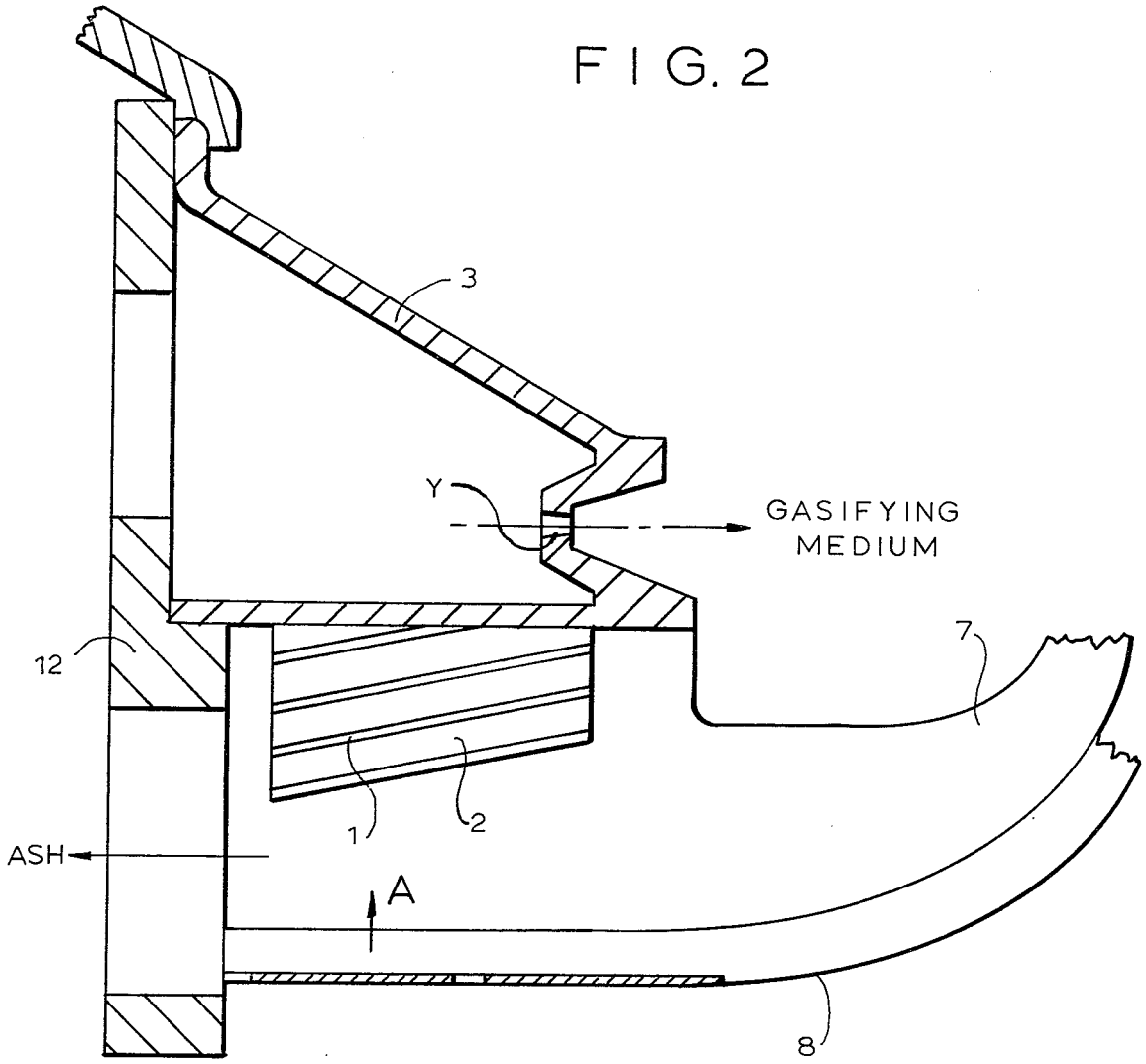
FIG. 2 is a view showing a section of the inventive slag breaker.
Figure 3:
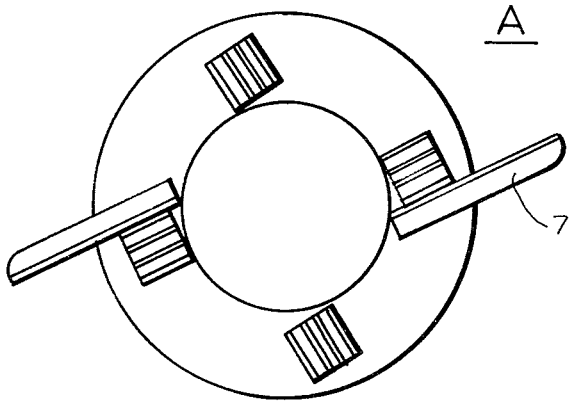
FIG. 3 is a view from below of the slag breaker.

A slag breaker in accordance with the present invention is used for a pressure-type coal gasifier having a rotary grate. A lower rotary grate segment is identified in the drawing by reference numeral 3 and has a gasifying medium discharge opening 4. A generator bottom is identified by reference numeral 8 and is provided with a wear plate 10 with breaking webs 11. The slag breaker has breaking plates which are identified by reference numeral 2.

The rotary grate is composed of several rotary grate segments 3. During the rotation of such a rotary grate, ash produced by an ash separator 7 during the generator process and small grain slag pieces are transported through an ash window 6 of the hollow shaft to further transportation. The slag pieces 9 which have an edge length exceeding h and cannot pass the ash window 6 of the hollow shaft, are broken and displaced through the ash window 6 to further transportation. This breakage is performed by the breaking plate 2 which are inclined by a falling angle of 10–15°, preferably 12°, in direction of rotation and also inclined radially inwardly by a falling angle of 5–10°, preferably 6°. The breaking plates 2 are located immediately before the ash separator 7 and provided with breaking projections 1 for improved and force-economical comminution the breaking plate 2 are releasably (for example by bolts) or non-releasably connected with the segments 3.

When it is necessary to change the direction of rotation of the grate, it is also possible to provide for a mirror-symmetrical arrangement of a further analogous breaking element 5 for breaking the slag during rotation in an opposite direction. The further mirror-symmetrical breaking arrangement may also include the breaking plate with the breaking projections, and the wear sheet with the breaking webs.

A ring 12 which is subdivided in mounting condition and arranged to close the ash window from above is further provided.

It will be understood that each of the elements described above, or two or more together, may also find a useful application in other types of constructions differing from the types described above.

While the invention has been illustrated and described as embodied in a slag breaker of a pressure-type coal gasifier, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of the present invention.

What is claimed as new and desired to be protected by Letters Patent is set forth in the appended claims.

1. A slag breaker of a pressure-type coal gasifier having a rotary grate with a plurality of grate segments rotatable therewith, a generator bottom, and an ash separator, the slag breaker comprising an inclined breaking plate arranged to jointly rotate with and to be located immediately below the grate segments and prior to the ash separator and provided with a plurality of breaking projections; and a wear sheet arranged to be located on the generator bottom and provided with a plurality of breaking webs so as to cooperate with said breaking projections of said breaking plate and to break slag below said rotary grate.

2. A slag breaker as defined in claim 1, wherein said breaking plate which carries said breaking projections, is inclined in two planes.

3. A slag breaker as defined in claim 1, wherein the rotary grate rotates in a predetermined direction, said breaking plate being inclined relative to the direction of rotation of the rotary grate by a falling angle of substantially between 10° and 15°.

4. A slag breaker as defined in claim 3, wherein said breaking plate is inclined to the direction of rotation of the rotary grate by a falling angle of 12°.

5. A slag breaker as defined in claim 1, wherein said breaking plate is inclined in a radial direction toward the ash separator by a falling angle of substantially between 5° and 10°.

6. A slag breaker as defined in claim 5, wherein said breaking plate is inclined in the radial direction by an angle of 6°.

7. A slag breaker as defined in claim 1, wherein said breaking plate has an inclined surface, said breaking projections extending substantially normal to said inclined surface.

8. A slag breaker as defined in claim 1, wherein the segments of the rotary grate include a lower segment, said breaking plate being arranged to be releasably connected with the lower segment of the rotary grate.

9. A slag breaker as defined in claim 1; and further comprising a further such inclined breaking plate with a further plurality of said breaking projections, said breaking plate being mirror-symmetrical relative to one another.

10. A slag breaker as defined in claim 1, wherein the coal gasifier has a hollow shaft and an ash window; and further comprising a ring which is subdivided in mounting condition and arranged to close the ash window from above.

11. A slag breaker as defined in claim 10, wherein said ring is fixedly connected with the hollow shaft.

12. A slag breaker as defined in claim 10, wherein said ring is releasably connected with the hollow shaft.

13. A pressure-type coal gasifier, comprising a rotary grate with a plurality of grate segments rotatable therewith; a generator bottom; an ash separator; and a slag breaker including an inclined breaking plate jointly rotatable with and located immediately below said grate segments and prior to said ash separator, and provided with a plurality of breaking projections, a wear sheet arranged on said generator bottom and provided with a plurality of breaking webs so as to cooperate with said breaking projections of said breaking plate and to break slag below said rotary grate.

* * * * *